United States Patent [19]

Jackson et al.

[11] Patent Number: 4,487,258

[45] Date of Patent: Dec. 11, 1984

[54] HYDRAULICALLY SET WELL PACKER

[75] Inventors: Alan T. Jackson, Irving; William D. Henderson, Frisco, both of Tex.

[73] Assignee: Otis Engineering Corporation, Dallas, Tex.

[21] Appl. No.: 523,376

[22] Filed: Aug. 15, 1983

[51] Int. Cl.[3] ..... F21B 23/04

[52] U.S. Cl. ..... 166/120

[58] Field of Search ..... 166/120, 122, 123–125, 166/134, 181, 182, 193, 212, 317, 318, 387, 381, 383, 237, 239

[56] References Cited

U.S. PATENT DOCUMENTS

| | | | |
|---|---|---|---|
| 3,008,523 | 11/1961 | Clark, Jr. et al. | 166/120 |
| 3,112,796 | 12/1963 | Myers | 166/120 |
| 3,136,364 | 6/1964 | Myers | 166/120 |
| 3,189,095 | 6/1965 | De Rochemont | 166/120 |
| 3,221,818 | 12/1965 | Taylor et al. | 166/187 |
| 3,283,824 | 11/1966 | Hoffman et al. | 166/212 |
| 3,398,796 | 8/1968 | Fisher, Jr. et al. | 166/120 |
| 3,645,335 | 2/1972 | Current | 166/120 X |

*Primary Examiner*—Stephen J. Novosad
*Assistant Examiner*—Thuy M. Bui
*Attorney, Agent, or Firm*—Thomas R. Felger

[57] ABSTRACT

A hydraulically set well packer. The setting sleeve is releasably locked to the packer mandrel to prevent premature setting while the packer is being lowered to its desired downhole location. The setting sleeve is unlocked by increasing fluid pressure within the packer mandrel above a preselected value. The length of the setting sleeve can be easily adjusted to accommodate additional piston units, changes in mandrel length, and various packing elements.

11 Claims, 15 Drawing Figures

HYDRAULICALLY SET WELL PACKER

BACKGROUND OF THE INVENTION

1. Field of the Invention

The present invention relates to well packers that are hydraulically set or anchored at a downhole location within a well bore by fluid pressure acting upon one or more pistons. Fluid pressure on the piston(s) generates sufficient force to compress packing elements which establish a fluid barrier and to radially expand slips which anchor the packer at the desired downhole location.

2. Description of the Prior Art

Hydraulically set well packers have been used in the oil and gas industry for many years. Examples of such prior packers are shown in U.S. Pat. No. 3,112,796 to W. D. Meyers; U.S. Pat. No. 3,136,364 to W. D. Meyers; U.S. Pat. No. 3,189,095 to J. F. De Rochemont; and U.S. Pat. No. 3,221,818 to F. H. Taylor et al. These patents are incorporated by reference for all purposes within this application.

Hydraulically set well packers are generally installed within the bore of a casing string which was previously cemented in place to define the well bore. Such packers are attached to a production tubing string at the well surface and lowered to the desired downhole location within the bore of the casing string. During this time period, the casing string is generally filled with a fluid such as drilling mud, salt water, or completion fluid. Movement of the tubing string and attached well packer into the casing bore causes the fluid to be displaced therefrom. This fluid displacement in turn tends to generate a difference in fluid pressure across the setting piston which may prematurely set the well packer before it reaches the desired downhole location. U.S. Pat. Nos. 3,112,796; 3,136,364; and 3,221,818 disclose various sliding sleeves which isolate the setting piston from fluid pressure until the respective packer is at its desired downhole location. In each patent, a ball is used to shift a sleeve from its first position blocking fluid pressure to its second position which allows fluid communication with the associated piston to set each well packer.

As shown in the prior art patents, shear pins, snap rings, and other devices are frequently used to releasably engage various components of each well packer to its mandrel. These devices prevent undesired movement of the components which could result in setting of the packer before it reaches the desired downhole location. These prior art devices, especially shear pins, are sometimes accidentally released or sheared by contact between the well packer and the inner wall of the casing string.

SUMMARY OF THE INVENTION

The present invention discloses a hydraulically set well packer which can be used to form a fluid barrier at a downhole location within a well bore. The packer comprises mandrel means with packing elements and anchoring means carried on the exterior thereof. The packing elements and anchoring means are positioned between a shoulder on the exterior of the mandrel means and a setting sleeve which surrounds a portion of the mandrel means. Piston means are slidably disposed on the exterior of the mandrel means and operatively engage the setting sleeve. The setting sleeve is releasably locked to the mandrel means until the fluid pressure applied to the piston means exceeds a preselected value.

One object of the present invention is to releasably lock the setting sleeve to the packer mandrel such that only fluid pressure above a preselected value will disengage the setting sleeve. Physical contact between the components of the well packer and the casing string during installation will not result in premature release of the setting sleeve.

Another object of the present invention is to provide a setting sleeve for a hydraulically set well packer which can be easily adjusted to provide different lengths of setting stroke for different types of packing elements.

Still another object of the present invention is to provide a setting sleeve and piston means which can be readily adapted to various well packers.

A further object of the present invention is to provide a hydraulically set well packer in which the number of piston means can be varied to vary the setting force.

Other advantages and objects of the present invention will be readily apparent to those skilled in the art from studying the written description in conjunction with the drawings and claims.

DESCRIPTION OF THE PREFERRED EMBODIMENTS

Figure 1A:
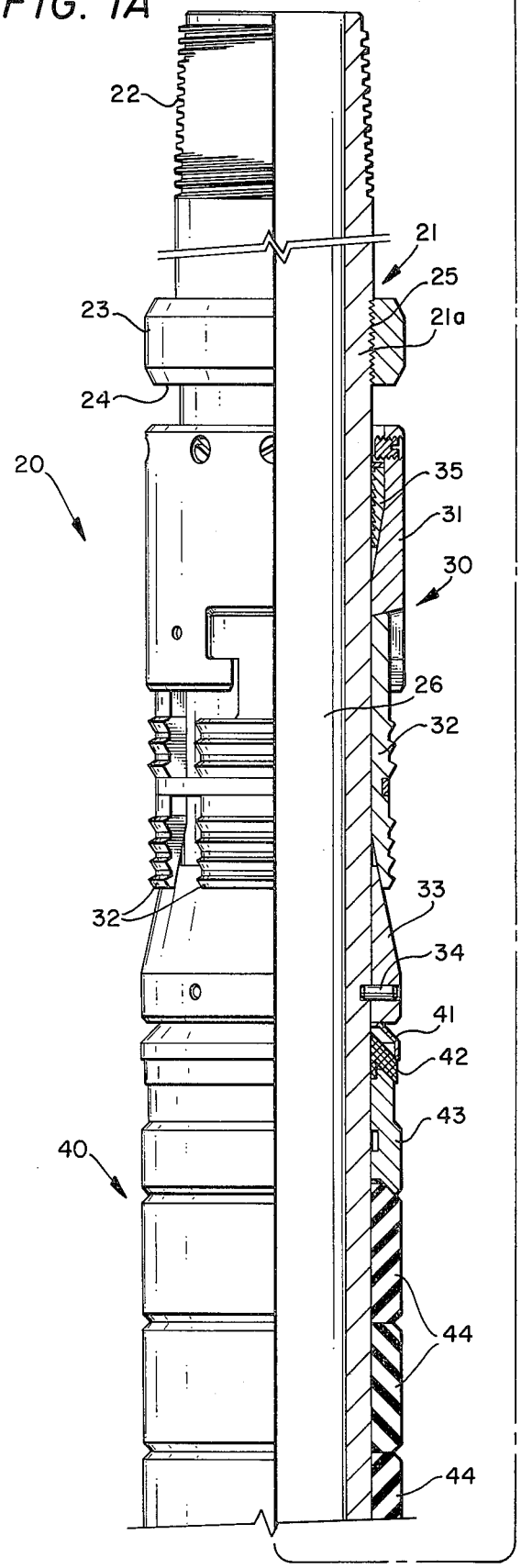
FIGS. 1A–1E are drawings, partially in section and partially in elevation with portions broken away, showing a well packer incorporating the present invention prior to installation within a well bore.
Figure 1B:
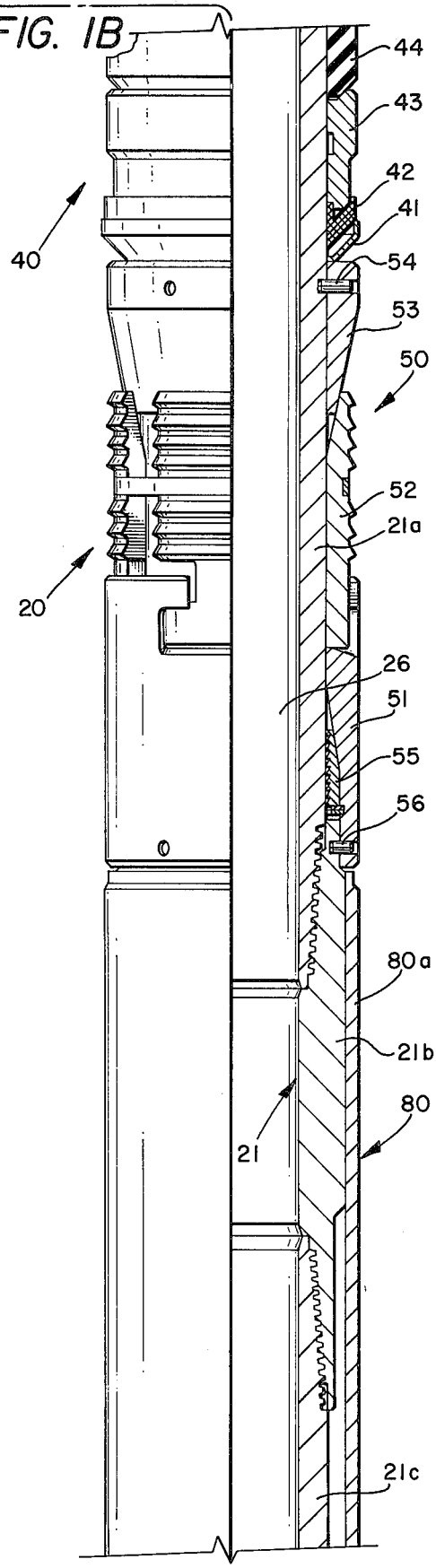
Figure 1C:
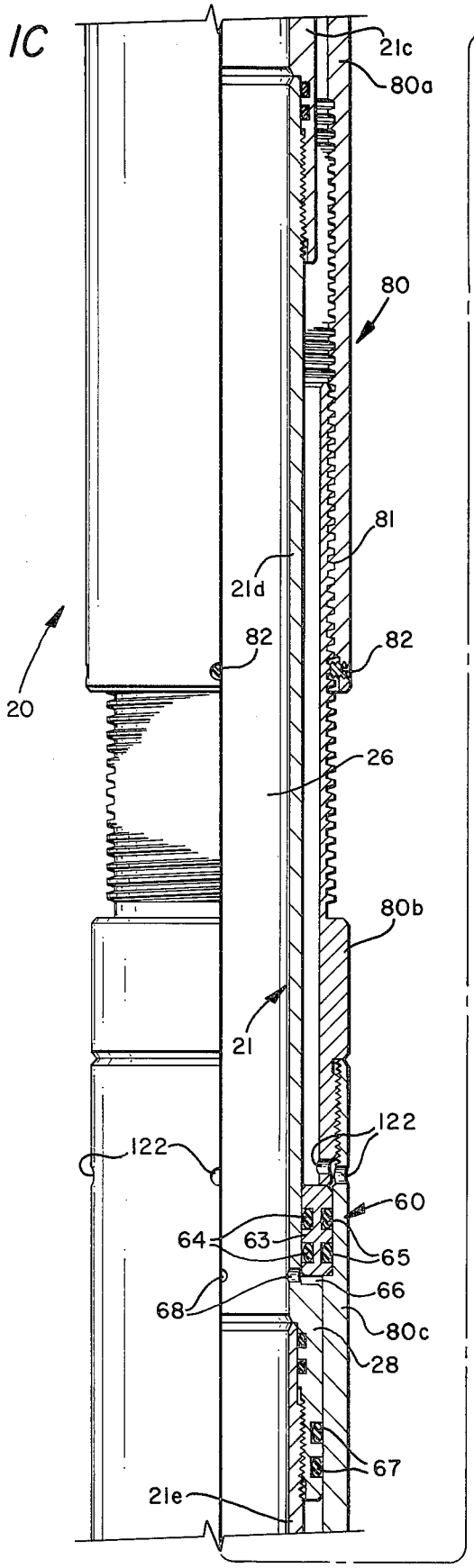
Figure 1D:
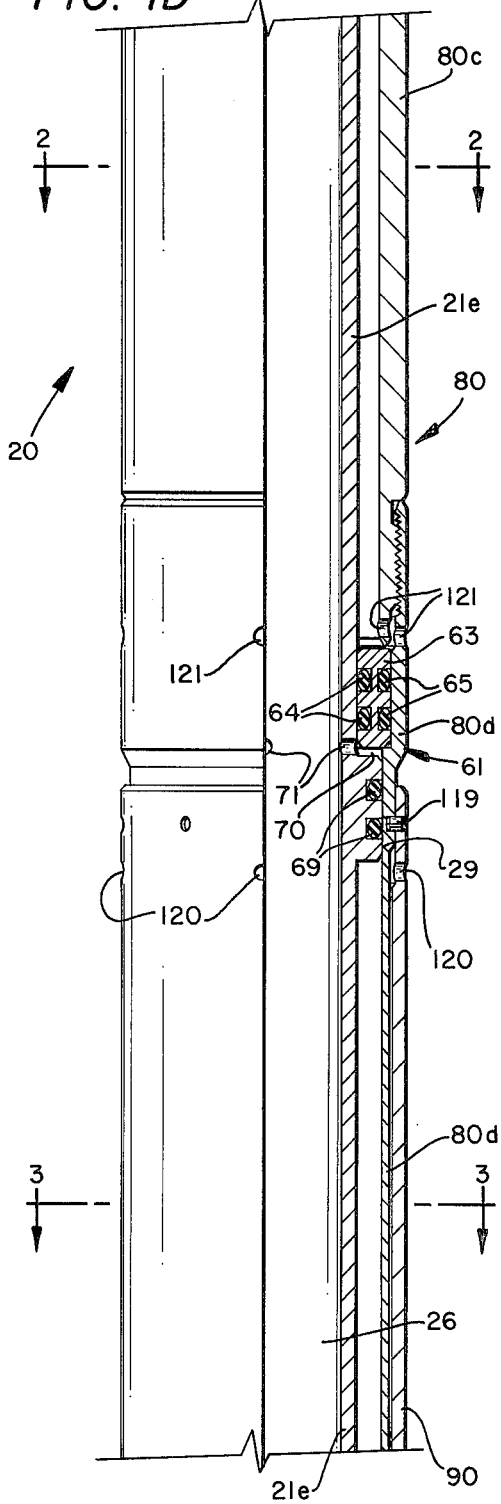

Well packer 20 is shown in FIGS. 1A–1E prior to installation within a well bore. The various components and elements which comprise packer 20 are attached to and carried by mandrel means 21. For ease of manufacture and assembly, mandrel means 21 consists of various sections concentrically engaged with each other by appropriate threaded connections. The various sections of mandrel means 21 are identified by an alphabetic designation following 21. Mandrel means 21 is basically a long, cylindrical tube with bore 26 extending therethrough.

Threads 22 are provided on the extreme end of mandrel section **21*a* to provide means for attaching well packer 20 to a production tubing string (not shown). Collar 23 is engaged by threads 25 to the exterior of mandrel means 21. As will be explained later, collar 23 provides first shoulder 24 on the exterior of mandrel means 21 for use in anchoring well packer 20** at the desired downhole location.

Upper slip assembly 30 comprising slip carrier 31, slips 32, and slip expander cone 33 are slidably carried on the exterior of mandrel means 21. A plurality of shear pins 34 releasably engage expander cone 33 to mandrel means 21 until after packer 20 has reached the desired downhole location. Internal slips 35 are disposed between slip carrier 31 and mandrel means 21. Internal slips 35 and first shoulder 24 cooperate to limit the longitudinal movement of upper slip assembly 30 during the setting of packer 20.

Seal assembly 40 is slidably carried on the exterior of mandrel means 21 adjacent to upper slip carrier 30. Seal assembly 40 comprises anti-extrusion rings 41, wire mesh rings 42, plastic (TEFLON) backup rings 43, and packing elements 44. Various alternative packer seal assemblies can be satisfactorily used with the present invention.

Figure 5A:
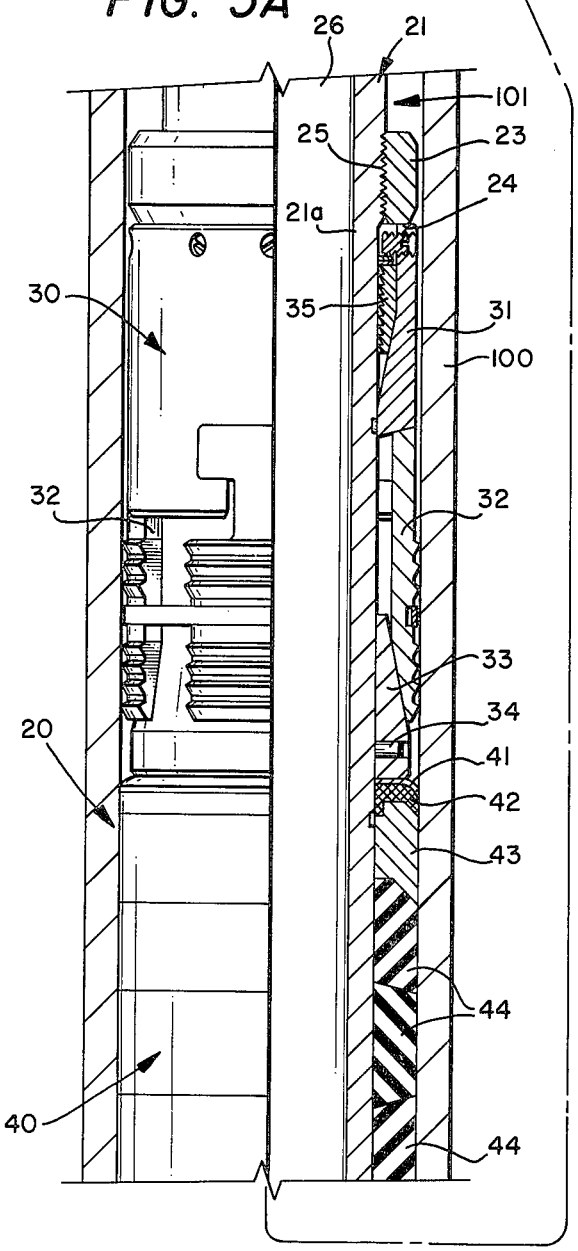
FIGS. 5A–5E are drawings, partially in section and partially in elevation with portions broken away, showing the well packer of FIGS 1A–1B anchored within the bore of a casing string.
Figure 5B:
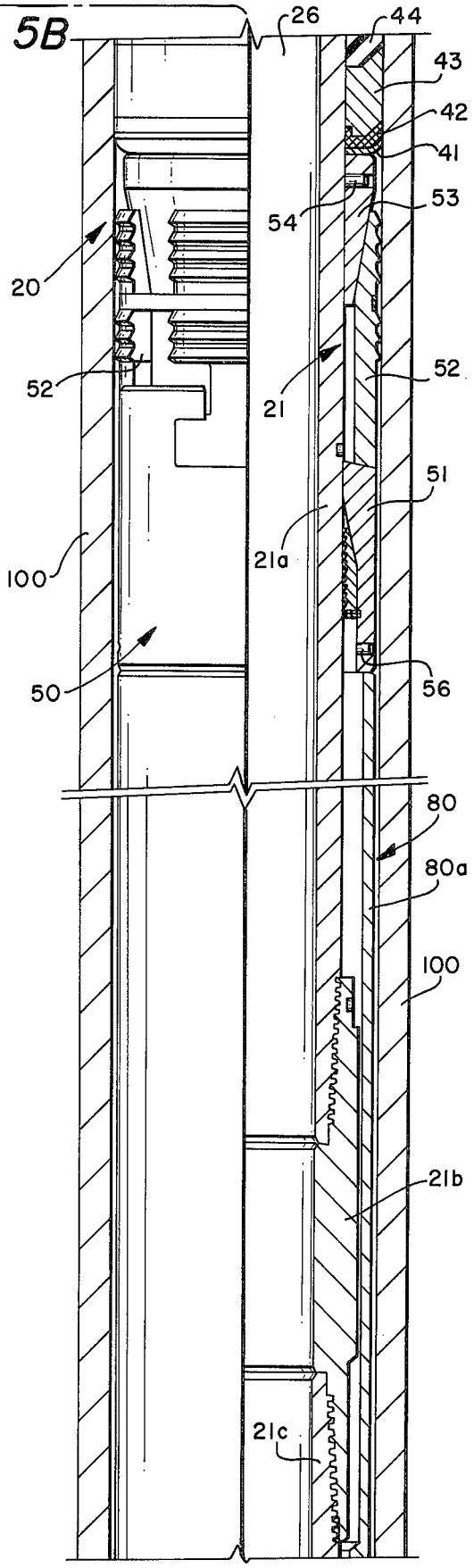
Figure 5C:
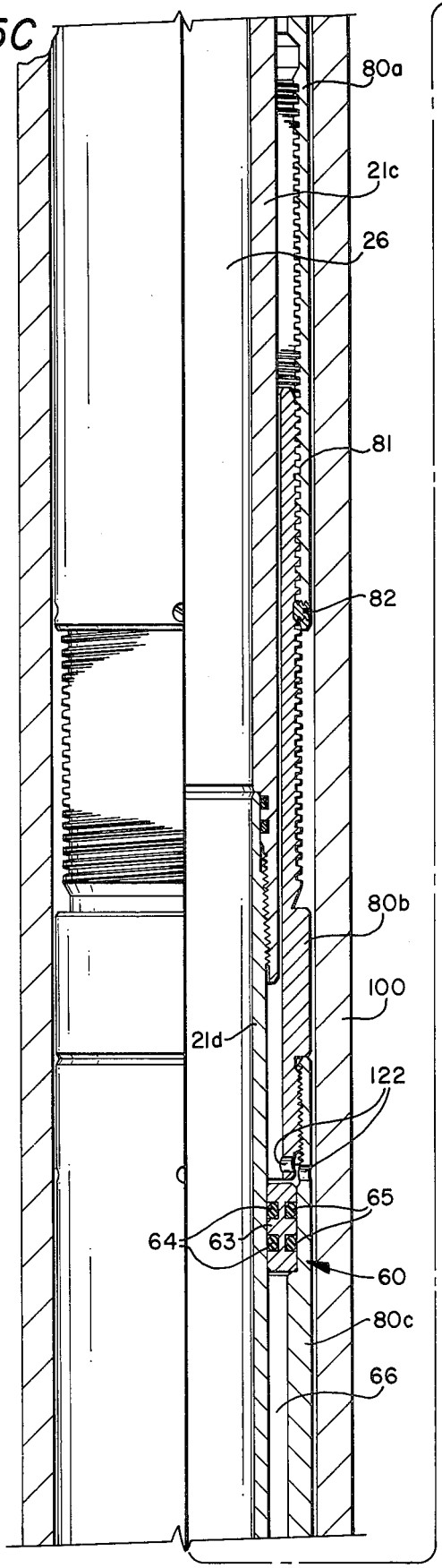
Figure 5D:
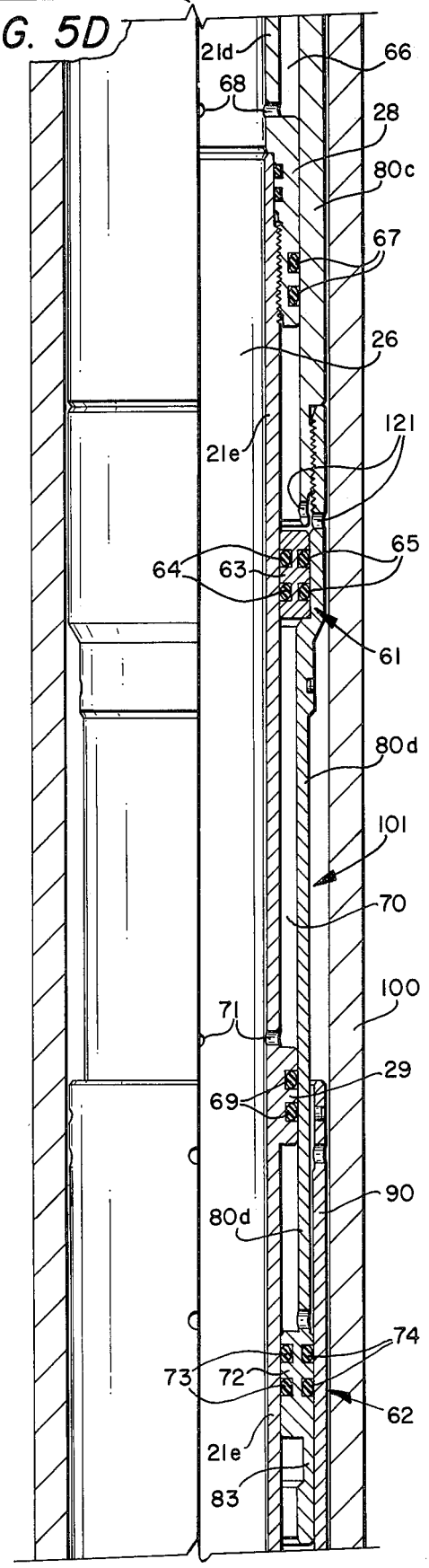

Lower slip assembly 50 is slidably disposed on the exterior of mandrel means 21 adjacent to seal assembly 40. Lower slip assembly 50 comprises slip carrier 51, slips 52 and slip expander cone 53. A plurality of shear pins 54 releasably engage expander cone 53 and shear pins 56 releasably engage slip carrier 51 to mandrel means 21. Shear pins 54 and 56 prevent slip carrier 51 and expander cone 53 from moving longitudinally towards each other until after packer 20 has reached the desired downhole location. As shown in FIGS. 5A and 5B, such longitudinal movement causes slips 52 to expand radially and to anchor packer 20 with the inner wall of casing string 100. Upper slip assembly 30 and lower slip assembly 50 comprise means for anchoring packer 20 at the desired downhole location.

Mandrel section 21*a* is attached to section 21*c* by adapter sub 21*b*. Mandrel section 21*a* carries the main components (anchoring means and packing elements) of well packer 20 as previously described. Mandrel sections 21*b* and 21*c* serve as an extension between mandrel section 21*a* and mandrel sections 21*d* and 21*e* on which piston means 60, 61, and 62 are slidably disposed. The length of mandrel section 21*c* is selected to be compatible with the required setting stroke of well packer 20.

Setting sleeve 80 surrounds mandrel sections 21*b*, 21*c*, 21*d*, and 21*e* and is longitudinally slidable relative to mandrel means 21. For ease of manufacture and assembly, setting sleeve 80 has four sections 80*a*, 80*b*, 80*c*, and 80*d* concentrically attached to each other by threaded connections. First section 80*a* abuts lower slip assembly 50. First section 80*a* is attached to second section 80*b* by acme threads 81. The threaded portions of sections 80*a* and 80*b* have sufficient length to allow significant variation in the combined length of sections 80*a* and 80*b* which allows the length of setting sleeve 80 to be adjusted to accommodate alternative packer seal assemblies. For example, one or more packing elements 44 could be removed and threads 81 adjusted to accommodate the change in stroke required to set well packer 20. Such a change might also require changing the location at which shear pins 54 and 56 engage mandrel means 21. Set screws 82 are provided to prevent undesired rotation of section 80*a* relative to section 80*b* after the proper length of setting sleeve 80 has been determined.

As will be explained later, fluid pressure from mandrel bore 26 can be applied to piston means 60, 61, and 62 to slide setting sleeve 80 longitudinally towards first shoulder 24. This movement of setting sleeve 80 radially expands slips 32 and 52 and compresses packing elements 44 thereby forming a fluid barrier with the inner wall of casing string 100 as shown in FIGS. 5A and 5B.

Piston means 60 includes piston ring 63 operatively attached to setting sleeve 80 by the engagement between sections 80*b* and 80*c*. Mandrel section 21*d* is slidably disposed within piston ring 63. Elastomeric seals 64 carried by piston ring 63 form a movable fluid barrier with the exterior of mandrel means 21. Elastomeric seals 65 carried by piston ring 63 form a static fluid barrier with the interior of setting sleeve 80. Elastomeric seals 67 are carried by enlarged outside diameter portion 28 of mandrel section 21*d* and form a movable fluid barrier with the inside diameter of setting sleeve 80 adjacent thereto. Variable volume fluid chamber 66 is provided between mandrel section 21*d* and setting sleeve section 80*c*. Piston ring 63 with its elastomeric seals 64 and 65 and enlarged outside diameter portion 28 with its elastomeric seals 67 partially define variable volume chamber 66. Ports 68 extend radially through mandrel section 21*d* allowing fluid communication between mandrel bore 26 and variable volume chamber 66. Port means 122 extend radially through setting sleeve 80 to communicate fluids between the exterior of setting sleeve 80 and the side of piston ring 63 opposite chamber 66.

Piston means 61 is similar in design to piston means 60. An identical piston ring 63 with elastomeric seals 64 and 65 is disposed between mandrel section 21*e* and setting sleeve section 80*d*. Piston ring 63 is operatively secured to setting sleeve 80 by the threaded connection between setting sleeve sections 80*c* and 80*d*. Enlarged outside diameter portion 29 of mandrel section 21*e* carries elastomeric seals 69 which form a movable fluid barrier with the inside diameter of setting sleeve 80 adjacent thereto. Variable volume fluid chamber 70 between mandrel means 21 and setting sleeve 80 is partially defined by elastomeric seals 64 and 65 on piston ring 63 and elastomeric seals 69. Port means 71 extends radially through mandrel section 21*e* and communicates fluid between mandrel bore 26 and variable volume fluid chamber 70. Port means 121 extend radially through setting sleeve 80 to communicate fluids between the exterior of setting sleeve 80 and the side of piston ring 63 opposite chamber 70.

Flange 72 is provided on the interior of setting sleeve section 80*d* near its extreme lower end. Elastomeric seal rings 73 are carried on the inside diameter of flange 72 and form a movable fluid barrier with the outside diameter of mandrel section 21*e* adjacent thereto. Elastomeric seal rings 74 are carried on the outside diameter of sleeve section 80*d* and form a movable fluid barrier with the inside diameter of protective cylinder 90 adjacent thereto. The function of protective cylinder 90 will be described later in more detail.

Mandrel means 21 terminates with end subassembly or mandrel section 21*f*. Mandrel section 21*e* is engaged by threads 91 to the inside diameter of end subassembly 21*f*. Protective cylinder 90 is engaged by threads 92 to the outside diameter of end subassembly 21*f*. Pins 93 are inserted through appropriately sized holes 97 in protective sleeve 90 and end subassembly 21*f* to prevent undesired rotation and possible disengagement of threads 91 and 92. Elastomeric seals 94 are carried by end subassembly 21*f* to form a static fluid barrier with the outside diameter of mandrel section 21*e* adjacent thereto. Elastomeric seals 95 are carried by end subassembly 21*f* to form a static fluid barrier with the inside diameter of protective cylinder 90 adjacent thereto. Elastomeric seals 73, 74, 94, and 95 cooperate to partially define variable volume fluid chamber 96 of piston means 62 between mandrel means 21 and setting sleeve 80.

A plurality of flexible collet fingers 110 are formed on mandrel section 21*f* and positioned within variable volume fluid chamber 96. Flexible collet fingers 110 are attached to mandrel means 21 via end subassembly 21*f* and threads 91. Collet head 111 is machined on the end of each collet finger 110. Annular recess 83 is provided on the inside diameter of setting sleeve section 80*d* disposed within variable volume fluid chamber 96. Annular recess 83 is sized to receive collet heads 111 therein. Flexible collet fingers 110 with their respective collet head 111 and annular recess 83 provide means for releasably locking setting sleeve 80 to mandrel means 21. Protective sleeve 90 prevents direct contact between collet fingers 110 or the end of setting sleeve 80 and any obstructions in the bore of casing 100 while lowering packer 20.

Figure 1E:
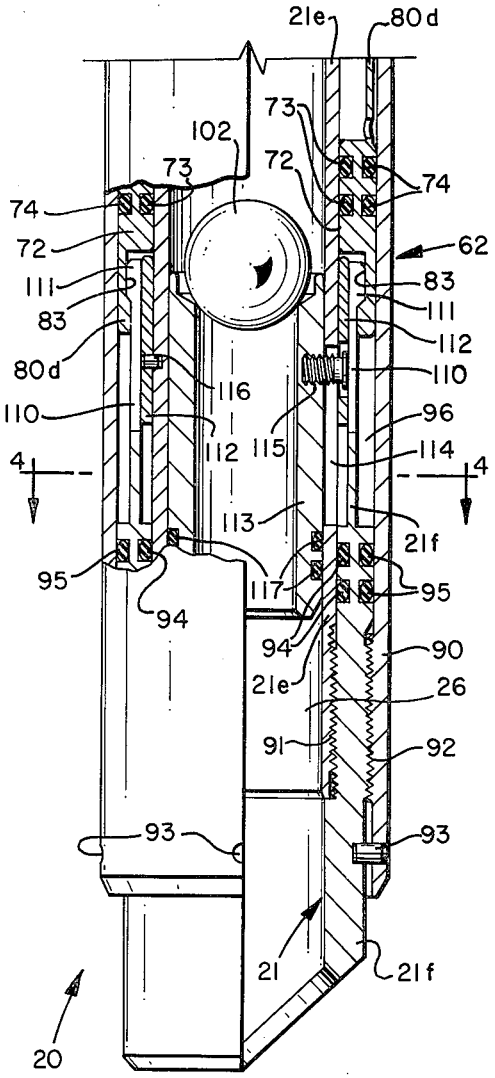
Figure 2:
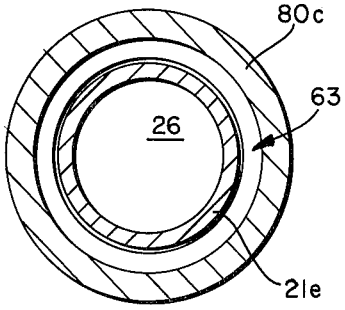
FIG. 2 is a cross-sectional view taken along line 2—2 of FIG. 1D.
Figure 3:
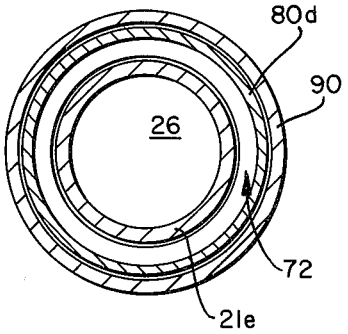
FIG. 3 is a cross-sectional view taken along line 3—3 of FIG. 1D.
Figure 4:
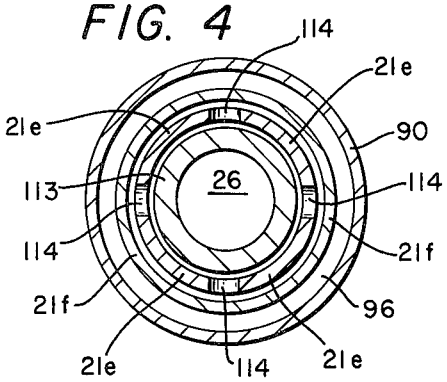
FIG. 4 is a cross-sectional view taken along line 4—4 of FIG. 1E.
Figure 7:
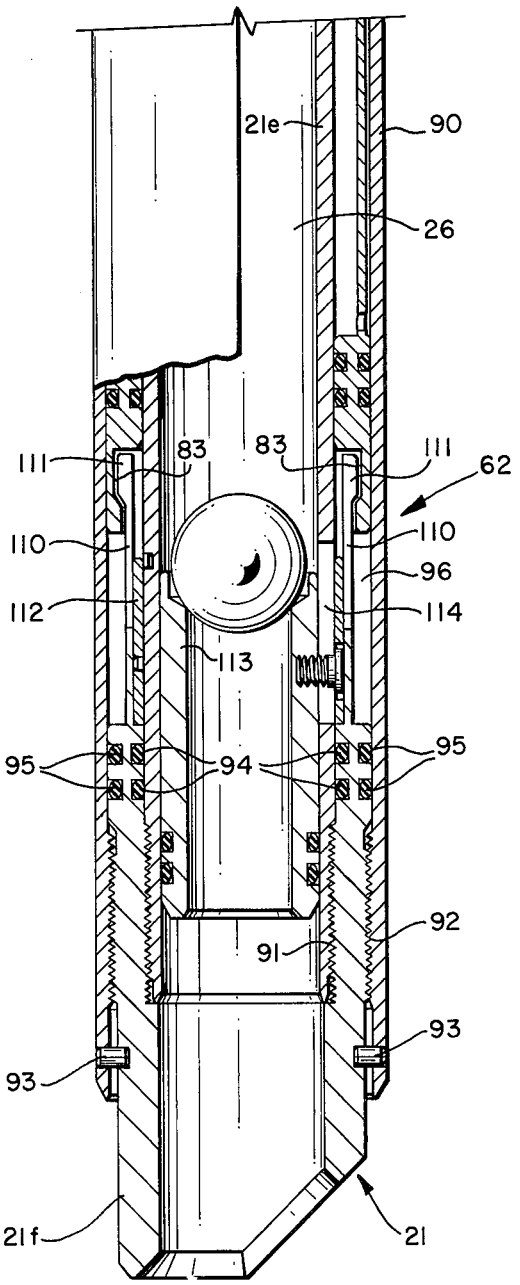
FIG. 7 is a drawing, partially in section and partially in elevation with portions broken away, showing the releasable locking means in its second position.

First cylinder 112 is slidably disposed on the exterior of mandrel section 21*e* between mandrel means 21 and collet finger 110. First cylinder 112 has a first position as shown in FIG. 1E which holds collet heads 111 engaged with recess 83 and a second position as shown in FIG. 7 which allows collet fingers 110 to flex and disengage collet heads 111 from recess 83. Second cylinder 113 is slidably disposed within the portion of mandrel bore 26 defined by mandrel section 21*e*. Second cylinder 113 is radially adjacent to first cylinder 112. A plurality of slots 114 extend longitudinally through a portion of mandrel section 21*e*. A heavy duty shear screw 115 is slidably positioned within each slot. Shear screws 115 and slots 114 provide means for connecting first cylinder 112 on the exterior of mandrel section 21*e* with second cylinder 113 on the interior of mandrel section 21*e*. Shear pin 116 is installed between first cylinder 112 and mandrel section 21*e* to releasably secure first cylinder 112 in its first position. O-rings 117 are carried on the exterior of second cylinder 113 to form a movable fluid barrier with the inside diameter of mandrel section 21*e* adjacent thereto. In addition to allowing connection between first cylinder 112 and second cylinder 113, slots 114 allow fluid communication between mandrel bore 26 and variable volume fluid chamber 96 during the setting of packer 20.

Installation and Setting Procedures

In FIGS. 1A–E, well packer 20 is shown prior to installation within bore 101 of casing 100. Using standard well completion techniques, well packer 20 can be attached by threads 22 to a production tubing string at the well surface (not shown) and lowered through bore 101 to the desired downhole location within casing 100. Ball 102 is generally dropped from the well surface via the tubing string into mandrel bore 26 after well packer 20 has been lowered to the desired location. Alternatively, ball 102 may be inserted into mandrel bore 26 immediately prior to lowering well packer 20. Ball 102 cooperates with second cylinder 113 and o-rings 117 to form a barrier against downward fluid flow through mandrel bore 26. Upward fluid flow can lift ball 102 out of engagement with second cylinder 113 to maintain fluid pressure equalized between the interior and the exterior of mandrel means 21.

When packer 20 is at its desired location, increased fluid pressure from the well surface is supplied to mandrel bore 26 via the production tubing string. As the fluid pressure above ball 102 increases, the shear value of pin 116 is selected to release first cylinder 112 from mandrel section 21*e* before any other components of well packer 20 move. Shearing pin 116 allows first cylinder 112 and second cylinder 113 to move downwardly from their first position as shown in FIG. 1E to their second position as shown in FIG. 7. This movement removes first cylinder 112 from behind collet heads 111 and allows flexing of collet fingers 110.

While second cylinder 113 is in its second position, increased fluid pressure in mandrel bore 26 above ball 102 is communicative with variable volume fluid chambers 66, 70, and 96 via ports 68 and 71 and slots 114, respectively. This increased fluid pressure causes piston means 60, 61, and 62 to apply force to setting sleeve 80. The shear value of pin 119 is selected to be higher than pin 116 and releases setting sleeve 80 from protective cylinder 90 after cylinder 113 has moved to its second position. Setting sleeve 80 can now move longitudinally towards first shoulder 24 because collet fingers 110 are free to flex radially inward. As fluid pressure within mandrel bore 26 is increased further, this pressure causes sufficient force to be applied to setting sleeve 80 to shear pins 56, 54, and 34 which allows compression of packing elements 44 and radial expansion of slips 52 and 32. This continued movement of setting sleeve 80 anchors packer 20 within casing 100 and forms a fluid barrier therewith as shown in FIGS. 5A–5E.

Figure 5E:
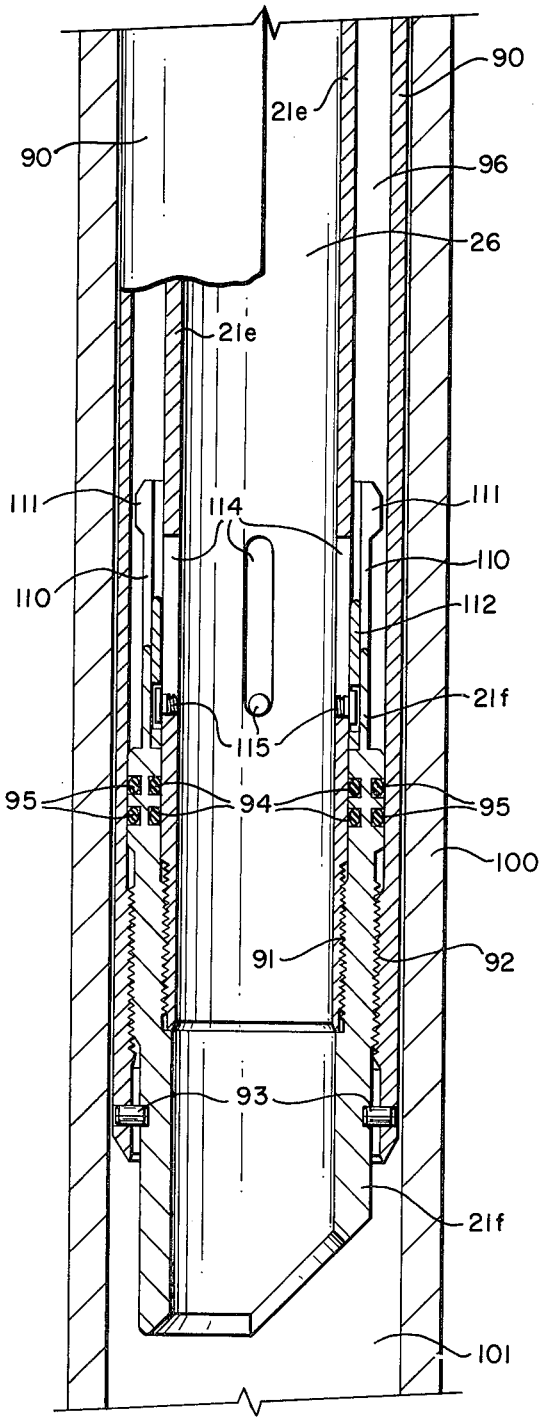
Figure 6:
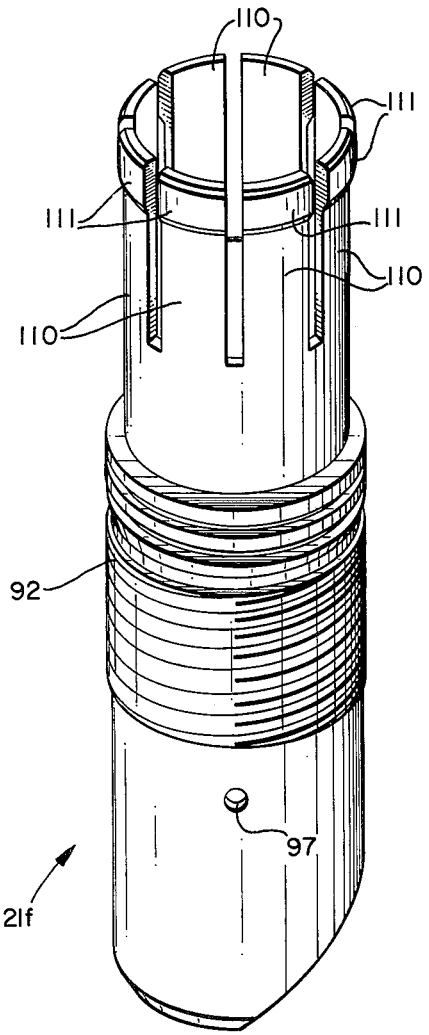
FIG. 6 is an isometric drawing of the end subassembly and collet fingers attached thereto.

By continuing to increase the fluid pressure above ball 102, sufficient force is applied to shear heavy duty screws 115 after packer 20 is set. Second cylinder 113 and ball 102 are then pumped out of the lower end of mandrel means 21 as shown in FIG. 5E. Unrestricted flow can occur in either direction through mandrel bore 26 after removal of ball 102 and second cylinder 113.

Alternative Embodiments

Those skilled in the art will see that the present invention readily allows the attachment of additional piston means 60 to mandrel means 21. Such extra piston means may be added for well packers requiring higher setting forces. Matching sets of mandrel section 21*d*, piston ring 63, and setting sleeve section 80*c* can be used to add the extra piston means.

If desired, end subassembly 21*f* can be modified to allow the attachment of other well tools thereto, such as a landing nipple or well screen. For some well completions, it may be necessary to attach additional joints of production tubing to end subassembly 21*f*. In order to support such additional weight below well packer 20, it may be necessary to increase the wall thickness of mandrel sections 21*d* and 21*e* and their respective threaded connections.

The present invention can be readily adapted to well packers with multiple mandrel means. In such packers, the piston means, setting sleeve and associated components would be carried by only one of the mandrel means. Also, the present invention can be used with anchoring means other than slip assemblies 30 and 50. Those skilled in the art will readily see other alternative embodiments without departing from the scope of the invention which is defined in the claims.

We claim:

1. A hydraulically set well packer, for forming a fluid barrier at a downhole location within a well bore, having a mandrel means with packing elements and anchoring means carried on its exterior and a longitudinal bore extending therethrough, comprising:

a. a shoulder on the exterior of the mandrel means;

b. a setting sleeve surrounding a portion of the mandrel means and longitudinally slidable relative thereto;
c. piston means slidably disposed on the exterior of the mandrel means and operatively engaging the setting sleeve;
d. the packing elements and anchoring means positioned between the shoulder and the setting sleeve;
e. an annular recess formed in a portion of the setting sleeve;
f. flexible collet fingers attached to the mandrel means;
g. a collet head on the end of each finger; and
h. means for releasably engaging the collet heads with the annular recess.

2. A well packer as defined in claim 1 wherein the releasable engaging means comprises:
a. a first cylinder slidably disposed on the exterior of the mandrel means between the mandrel means and the collet fingers;
b. the first cylinder having a first position which holds the collet heads engaged with the annular recess and a second position which allows the collet fingers to flex and disengage the collet heads from the annular recess;
c. a second cylinder disposed within the bore of the mandrel means adjacent to the first cylinder;
d. means for connecting the first cylinder to the second cylinder; and
e. means for sliding the second cylinder longitudinally with respect to the mandrel means when fluid pressure within the mandrel bore exceeds the preselected value.

3. A well packer as defined in claim 2 wherein the connecting means further comprises:
a. a plurality of longitudinal slots extending through the mandrel means;
b. the first cylinder and second cylinder disposed on opposite sides of the longitudinal slots; and
c. a shear screw slidably disposed within each slot and attached to the first cylinder and second cylinder.

4. A well packer as defined in claim 3 wherein the sliding means further comprises:
a. a shear pin releasably securing the first cylinder in its first position; and
b. a ball disposed within the bore of the mandrel means and engaging the second cylinder to block fluid flow in one direction therethrough.

5. A well packer as defined in claim 1 having a protective sleeve attached to the mandrel means and surrounding the releasably locking means.

6. A well packer as defined in claim 1 wherein the setting sleeve further comprises:
a. a first section and a second section with the first section abutting a portion of the anchoring means and the second section operatively engaged with the piston means;
b. the first and second sections attached to each other by a threaded connection; and
c. the threaded connection allowing adjustment of the length of the setting sleeve to accommodate variations in the length of the mandrel means and packing elements carried thereon.

7. A well packer as defined in claim 6 wherein the releasable locking means comprises:
a. an annular recess formed in a portion of the setting sleeve;
b. flexible collet fingers attached to the mandrel means;
c. a collet head on the end of each finger;
d. a first cylinder slidably disposed on the exterior of the mandrel means between the mandrel means and the collet fingers;
e. the first cylinder having a first position which holds the collet heads engaged with the annular recess and a second position which allows the collet fingers to flex and disengage the collet heads from the annular recess; and
f. the protective sleeve preventing undesired contact between the collet fingers and obstructions in the well bore while lowering the well packer therethrough.

8. A hydraulically set well packer, for forming a fluid barrier at a downhole location within a well bore, having a mandrel means with packing elements and anchoring means carried on its exterior and a longitudinal bore extending therethrough, comprising:
a. a shoulder on the exterior of the mandrel means;
b. a setting sleeve surrounding a portion of the mandrel means and longitudinally slidable relative thereto;
c. piston means slidably disposed on the exterior of the mandrel means and operatively engaging the setting sleeve;
d. the packing elements and anchoring means positioned between the shoulder and the setting sleeve;
e. an annular recess formed in a portion of the setting sleeve;
f. flexible collet fingers attached to the mandrel means;
g. a collet head on the end of each finger;
h. the collet heads and annular recess providing means for releasably locking the setting sleeve to the mandrel means; and
i. means for releasing engagement between the collet heads and the annular recess.

9. A well packer as defined in claim 8 wherein the engagement releasing means comprises:
a. a first cylinder slidably disposed on the exterior of the mandrel means between the mandrel means and the collet fingers;
b. the first cylinder having a first position which holds the collet heads engaged with the annular recess and a second position which allows the collet fingers to flex and disengage the collet heads from the annular recess;
c. a second cylinder disposed within the bore of the mandrel means adjacent to the first cylinder;
d. means for connecting the first cylinder to the second cylinder; and
e. means for sliding the second cylinder longitudinally with respect to the mandrel means when fluid pressure within the mandrel means exceeds a preselected value.

10. A well packer as defined in claim 9 further comprising a protective sleeve attached to the mandrel means and surrounding the means for releasably locking the setting sleeve to the mandrel means.

11. A well packer as defined in claim 10 wherein the setting sleeve further comprises:
a. a first section and a second section with the first section abutting a portion of the anchoring means and the second section operatively engaged with the piston means;
b. the first and second sections attached to each other by a threaded connection; and
c. the threaded connection allowing adjustment of the length of the setting sleeve to accommodate variations in the length of the mandrel means and packing elements carried thereon.

* * * * *